United States Patent [19]

Sherwood et al.

[11] Patent Number: 4,712,651

[45] Date of Patent: Dec. 15, 1987

[54] ELEVATOR CAB

[75] Inventors: Edward F. Sherwood, Gettysburg; Karl B. Orndorff, Bonneauville Boro, both of Pa.

[73] Assignee: Westinghouse Electric Corp., Pittsburgh, Pa.

[21] Appl. No.: 863,486

[22] Filed: May 15, 1986

[51] Int. Cl.[4] ..... B66B 11/02; F21S 1/02

[52] U.S. Cl. ..... 187/1 R; 367/148; 52/28

[58] Field of Search ..... 187/1 R; 362/148, 150, 362/366, 365; 52/28, 39

[56] References Cited

U.S. PATENT DOCUMENTS

| | | | |
|---|---|---|---|
| 2,463,046 | 3/1949 | Naysmith | 52/28 X |
| 3,121,259 | 2/1964 | Versen | 52/28 |
| 3,265,879 | 8/1966 | Ford et al. | 362/150 |
| 3,459,399 | 8/1969 | Everson | 52/39 X |
| 3,511,463 | 5/1970 | Nute, Jr. et al. | 362/150 X |
| 3,788,206 | 1/1974 | Mulvey | 362/365 X |
| 4,164,011 | 8/1979 | Sherwood | 362/148 |
| 4,577,264 | 3/1986 | Plumly | 362/150 X |

*Primary Examiner*—Joseph J. Rolla
*Assistant Examiner*—Nils Pedersen
*Attorney, Agent, or Firm*—D. R. Lackey

[57] ABSTRACT

An elevator cab having a drop ceiling suspended from the cab canopy. The drop ceiling includes a skeleton frame and a plurality of metallic pan members carried by the frame. Each pan member includes a sheet metal member having a lower decorative side viewable from inside the cab, and an upper side having reinforcing and stiffening brackets to which one or more down lights are attached and centered over openings in the sheet metal member. The upper side also carries slidable clip members along the edges of the sheet metal member, with the clip members, when actuated from a retracted to an extended position, securing the pan member to the frame by sandwiching a frame element between the lower sheet metal member and the upper clip members. The sheet metal members of the pan members butt tightly together to conceal intermediate angle members of the frame, and the outer edges of the pan members conceal perimetrically arranged angle members of the frame.

1 Claim, 4 Drawing Figures

ELEVATOR CAB

BACKGROUND OF THE INVENTION

1. Field of the Invention

The invention relates in general to elevator cabs, and more specifically to a new and improved drop ceiling construction for elevator cabs.

2. Description of the Prior Art

An elevator cab usually includes a ceiling or canopy, sidewall which support the canopy, a decorative drop ceiling suspended from the canopy, and a light source between the canopy and drop ceiling. In some constructions the light fixtures are fastened to the canopy, and thus the drop ceiling may consist of a frame suspended from the canopy and relatively light "egg crate" type panels supported by the frame. In more decorative constructions, a plurality of lamp or light fixtures called "down lights" are fixed to the drop ceiling, on the upper side thereof, with the cab illumination being provied by openings through the drop ceiling below each lamp fixture. In this latter construction, the drop ceiling is relatively heavy, and the assembly of the drop ceiling to the canopy is usually done in the factory. Even with factory assembly, however, the assembly of the drop ceiling to the canopy is usually time consuming. Thus, it would be desirable to provide a new and improved drop ceiling of the type which includes a plurality of down lights secured thereto, which drop ceiling is substantially lighter than the drop ceilings of the prior art, and which may be more quickly assembled with the canopy, whether the assembly is performed in the factory or at the job site.

SUMMARY OF THE INVENTION

Briefly, the present invention is a new and improved elevator cab having a drop ceiling with down lights, featuring a construction which reduces the weight of the drop ceiling assembly while retaining the requisite mechanical strength. The disclosed construction also facilitates the assembly of the drop ceiling assembly with the cab canopy. The drop ceiling includes a frame, such as normally used with the drop ceilings which do not support lamp fixtures, and a plurality of drop ceiling pan assemblies which are supported by the frame. Each pan assembly includes a metallic sheet member having upper and lower surfaces, and outer edges, with elongated slidable clips mounted on the upper surface, adjacent to the edges of the metallic sheet member. Elongated bracket members are fixed to the upper surface of the metallic sheet member, one on each side of openings disposed through the sheet member for directing illumination from the down lights into the cab interior. The down lights are fixed to the bracket members, and thus the bracket members serve to fasten all of the down lights associated with the pan assembly, while also functioning as stiffening members for the metallic sheet member. Each slidable clip has retracted and advanced positions, securable by captive nuts and studs, with the pan assembly being intially positioned below the frame with the slidable clips retracted. The slidable clips are then advanced over horizontal leg portions of the angle members which make up the frame, and the nuts are tightened on the studs to firmly secure the pan assembly to the frame. If the drop ceiling is assembled with the cab canopy in the factory, the assembly is shipped to the job site and suspended in the hoistway while the sidewalls of the cab are assembled on the platform. The assembly is then lowered into position on the top edges of the sidewalls, and secured. If it is desired to assemble the drop ceiling in the field, the cab, including its canopy, is constructed on a platform, and the frame is suspended from the canopy. The pan assemblies are then placed into position from below the frame, one by one, with an assembler on top of the cab securing the pan assemblies to the frame by actuating the clips and tightening the nuts. The assembler may reach through the opening in the canopy provided for the emergency escape panel. The metallic sheet members of the pan assemblies completely cover the perimetrically arranged angle members of the frame, and edges of the pan assemblies butt together to conceal cross members of the frame.

BRIEF DESCRIPTION OF THE DRAWINGS

The invention may be better understood, and further advantages and uses of the invention more readily apparent, when considered in view of the following detailed description of exemplary embodiments, taken with the accompanying drawings in which.

DESCRIPTION OF PREFERRED EMBODIMENTS

Figure 1:
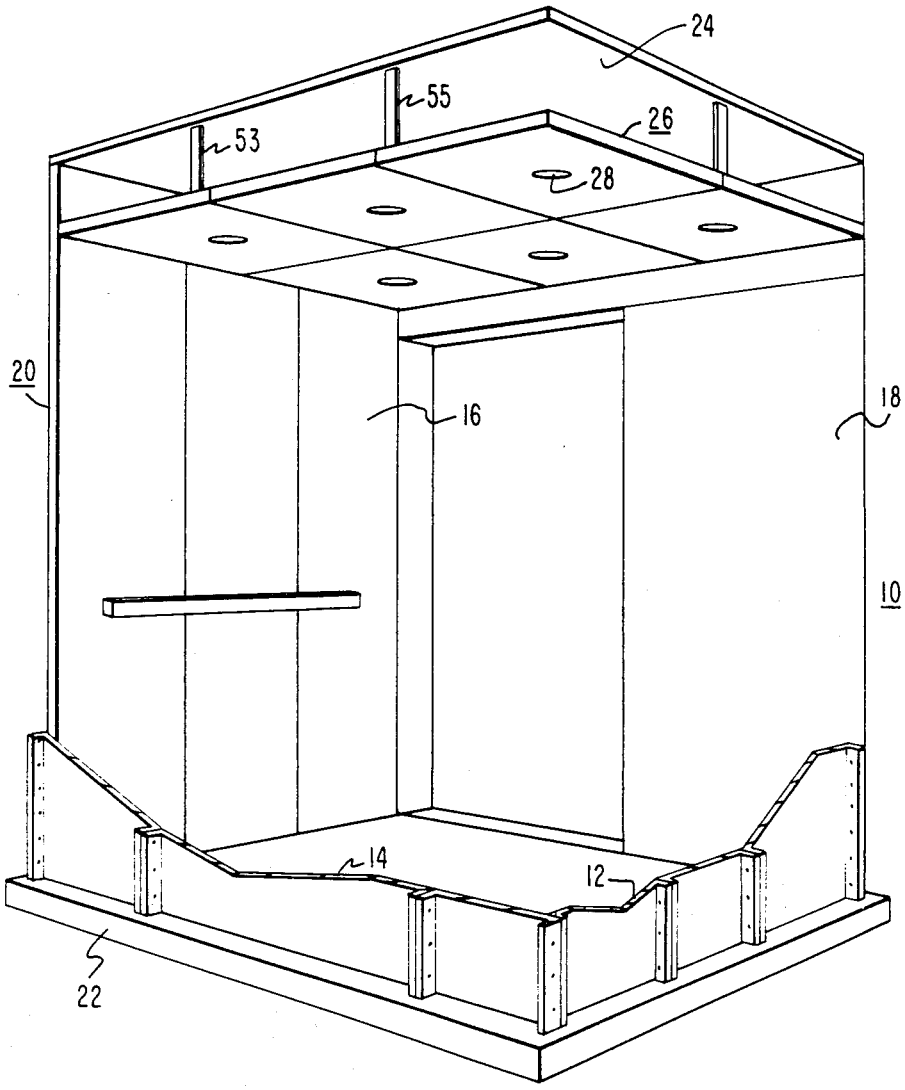
FIG. 1 is a perspective view of an elevator cab, shown partially cut away, illustrating a drop ceiling which may be constructed according to the teachings of the invention.

Referring now to the drawings, and to FIG. 1 in particular, there is shown an elevator cab 10 which may be constructed according to the teachings of the invention. Cab 10 includes four upstanding sidewall portions 12, 14, 16 and 18, which are assembled to define an enclosure 20 which is supported by a platform 22. A canopy 24 is attached to the upper edges of the enclosure 20. A drop ceiling 26 is suspended from the canopy, with drop ceiling 26 being of the type which carries a plurality of down lights which illuminate the inside of enclosure 20 via a plurality of openings 28.

Figure 2:
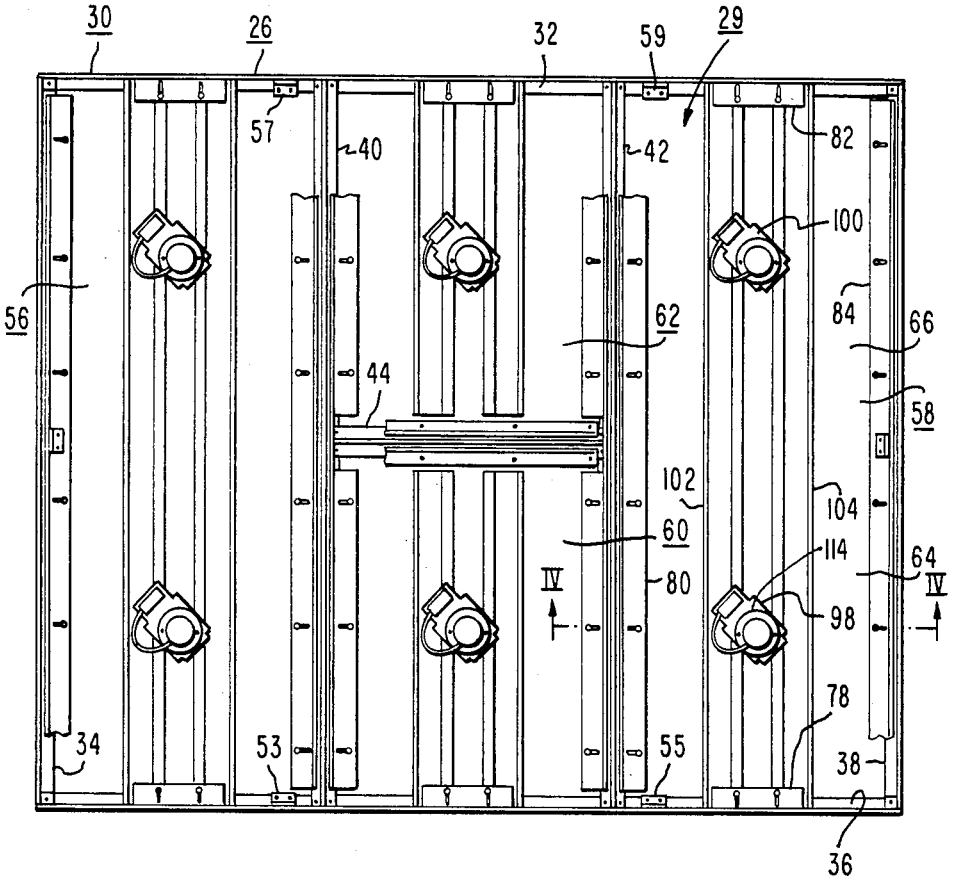
FIG. 2 is a plan view of the upper surface of a drop ceiling constructed according to the teachings of the invention.
Figure 3:
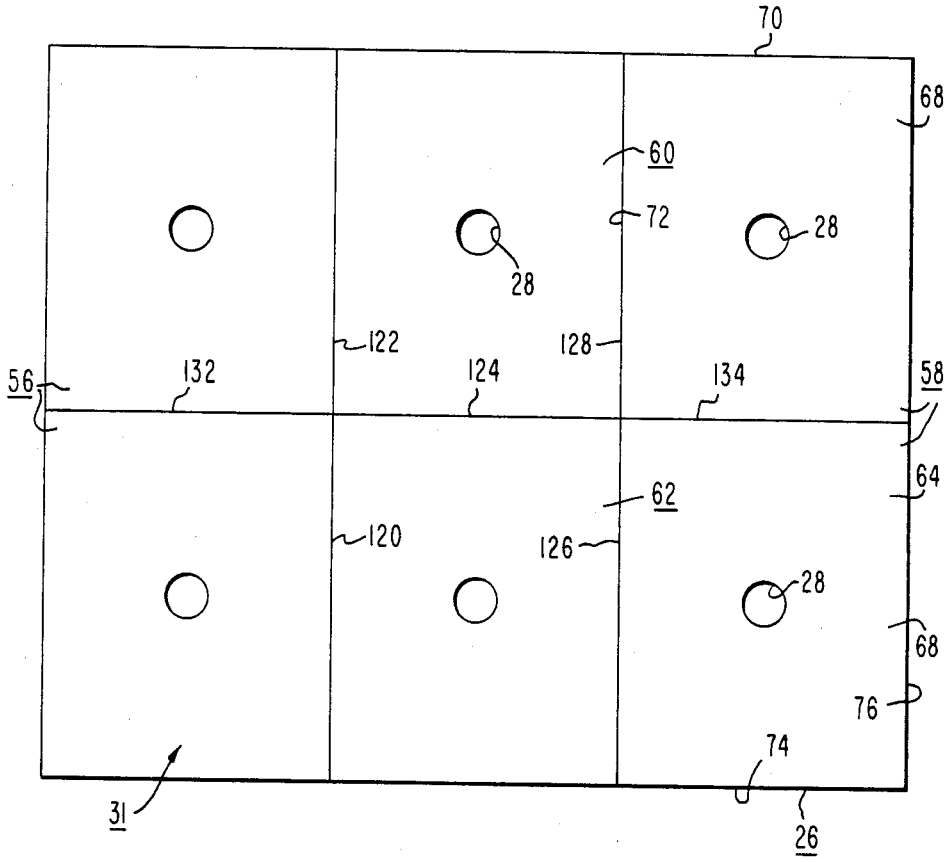
FIG. 3 is a view of the lower surface of the drop ceiling shown in FIG. 2.
Figure 4:
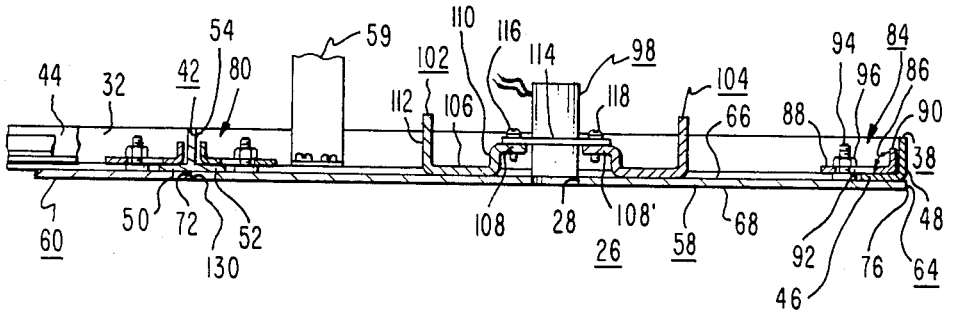
FIG. 4 is a cross-sectional view of the drop ceiling shown in FIG. 2, taken between and in the direction of arrows IV—IV.

Referring now to FIGS. 2, 3 and 4, FIG. 2 is a plan view of the uppermost side 29 of a drop ceiling 26 which is constructed according to the teachings of the invention; FIG. 3 is a view of the lower side 31 of drop ceiling 26; and, FIG. 4 is a cross-sectional view of drop ceiling 26, taken between and in the direction of arrows IV—IV in FIG. 2. Drop ceiling 26 includes a frame 30 constructed of angle members, including a plurality of interconnected perimetrical right-angle members 32, 34, 36 and 38. In other words, each elongated right-angle member has its two ends connected to ends of two other right-angle members, to define a square or rectangular configuration. Frame 30 also includes one or more intermediate angle members, such as intermediate angle members 40 and 42 which extend between right-angle members 32 and 36. In order to provide an opening in frame 30 aligned with the escape opening (not shown) in canopy 24, an additional intermediate angle member 44 may extend between the intermediate angle members 40 and 42. Each of the intermediate angle members 40, 42 and 44 have an inverted T-shaped cross-sectional configuration. Thus, each of the angle members of frame 30 have a horizontally oriented leg portion and an upstanding leg portion. For example, as shown in FIG. 4, right angle member 38 has a horizontally oriented leg portion 46 and an upstanding leg portion 48; and, the intermediate angle member 42 has horizontally oriented leg portions 50 and 52, and an upstanding leg portion 54. Frame 30 is suspended from canopy 24 via a plurality of hanger straps, such as hanger straps 53 and 55 shown in FIGS. 1 and 2, and hanger straps 57 and 59 shown in FIGS. 2 and 4.

Drop ceiling 26 further includes a plurality of pan assemblies 56, 58, 60 and 62. Pan assemblies 56 and 58 both extend between right-angle members 32 and 36, with pan assembly 56 extending along right-angle member 34 and inverted T-shaped angle member 40, and with pan assembly 58 extending along right-angle member 38 and inverted T-shaped angle member 42. Pan assemblies 60 and 62 are disposed between pan assemblies 56 and 58, with pan assembly 60 having edges which extend along right angle member 36 and inverted T-shaped angle members 40, 42 and 44, and with pan assembly 62 having edges which extend along right angle member 32 and inverted T-shaped members 40, 42 and 44. Since each of the pan assemblies is of like construction, except for its length dimension and the number of down lamp fixtures it supports, only pan member 58 will be described in detail.

Pan assembly 58 includes a metallic sheet metal member 64 having upper and lower major, flat surfaces 66 and 68, respectively. The sheet metal member 64 may be selected from any one of several different materials. For example, it may be a mild steel with the lower surface 68 being a baked enamel, or a plastic laminate; it may be a stainless steel, with a satin or a mirror finish on the lower surface 68; it may be a bronze with a satin or a mirror finish on the lower surface 68, and the like.

Sheet metal member 64 has four outer edges 70, 72, 74 and 76, best shown in FIG. 3. Elongated slidable clip members are fixed adjacent to each of the edges of the sheet metal member 64, on the side of its upper surface 66. For example, slidable clip members 78, 80, 82 and 84 are disposed adjacent to edges 70, 72, 74 and 76, respectively. Each of the clip members, such as clip member 84 shown in FIG. 4, includes an elongated right-angle member 86 having a horizontally oriented leg portion 88 and an upstanding leg portion 90. The horizontally oriented leg portion 88 includes a plurality of spaced slots, such as slot 92. Clip member 84 further includes a plurality of stud members, such as stud 94, which are welded to the upper surface 66 of the sheet metal member 64. The stud members 94 each extend upwardly through one of the plurality of slots 92 in the leg portion 88, and a nut 96 is threadably engaged with the stud 94 to capture the elongated right-angle member 86. The slots, such as slot 92, are oriented such that the clip member 84 has a retracted position, relative to the associated edge of the sheet metal member 64, such as edge 76, and an extended position in which the right-angle member 86 is extended toward the associated edge 76.

An opening 28 is provided in sheet metal member 64 for each down lamp fixture it is to support. In the exemplary embodiment of the invention shown in the figures, sheet metal member 64 supports first and second down lamp fixtures 98 and 100, respectively, so it is provided with two spaced openings 28.

In order to stiffen metallic sheet member 58, as well as to provide means for supporting the down lamp fixtures 98 and 100, first and second elongated bracket members 102 and 104 are welded, or otherwise firmly secured, to the upper surface 66 of the metallic sheet member 64. Bracket members 102 and 104 are disposed on opposite sides of the openings 28, and oriented to extend between edges 70 and 74.

Each bracket member, such as bracket member 102, includes first and second horizontally oriented leg portions 106 and 108, respectively, interconnected by an upstanding leg portion 110. A second upstanding leg portion 112 may also be provided, to further add rigidity to the bracket member. The first horizontally oriented leg portion 106 is fixed to surface 66 of the sheet metal member 64, and the second horizontally oriented leg member 108 provides a flange for mounting a down lamp fixture. As shown in FIG. 4, down lamp fixture 98 includes a mounting flange 114 which is secured to leg portions of both bracket members 102 and 104, such as to leg portions 108 and 108′ of bracket members 102 and 104, respectively, by suitable fastening means, such as screws 116 and 118.

To assemble pan assembly 58 to frame 30, the slidable clip members 78, 80, 82 and 84 are actuated to their retracted positions. If the components of the drop ceiling are factory assembled, frame 30 is placed on top of the pan assembly 58, the clips are actuated to their advanced positions in which they extend over the horizontal leg portions of the angle members of frame 30, and the nuts are tightened on the studs to secure the clips tightly against the frame 30. If the components of the drop ceiling are assembled in the field, frame 30 is suspended from the canopy, an installer located in the cab lifts each pan assembly into position, and a second installer located on top of cab 10 reaches through the emergency escape opening in the canopy to actuate the clip members 78, 80, 82 and 84 to their advanced positions, and to tighten the nuts 96.

The metallic sheet member 64 is dimensioned such that it completely conceals the perimetrically arranged right-angle members of the frame 30, when viewed from a vantage point inside cab 10, and it is dimensioned to conceal one-half of the inverted T-shaped angle member 42. When the other pan assemblies are positioned and secured to frame 30, their edges butt tightly against the edges of the adjoining pan assemblies to create tight butt joints 120, 122, 124, and 126 and 128 which conceal the inverted T-shaped angle members. For example, edge 130 of pan assembly 60 butts tightly against edge 72 of pan assembly 58. As shown in FIG. 3, pan assemblies 56 and 58 may have their lower surfaces scribed to simulate tight butt joints, such as scribe marks 132 and 134.

In summary, there has been disclosed a new and improved elevator cab having a drop ceiling assembly with down lights constructed of a frame and a plurality of metallic pan members. Each pan member is constructed of a bracket reinforced metallic sheet member which has down lights secured to the stiffening bracket members. The down lights are centered over openings in the metallic sheet member to illuminate the interior or the cab. Each pan member has a plurality of slidable clip members which are actuatable from a retracted configuration to an advanced position to capture frame elements between the metallic sheet member and the slidable clip members. The metallic sheet members of the pan members butt tightly together to conceal intermediate angle members of the frame, and they also conceal perimetrically arranged angle members of the frame.

We claim as our invention:

1. An elevator cab, comprising:

a canopy, sidewalls supporting said canopy, a frame suspended from said canopy, a plurality of drop ceiling pan assemblies supported by said frame, with each pan assembly including a metallic sheet member having upper and lower surfaces, and outer edges, at least two spaced openings in one of said pan assemblies which extend between the upper and lower surfaces of the metallic sheet member, first and second elongated bracket members fixed in spaced relation to the upper surface of said metallic sheet member, on opposite sides of said at least two spaced openings, to stiffen said metallic sheet member and to provide an elongated space between the spaced bracket members for receiving down lamp fixtures, and a down lamp fixture centered over each of said at least two spaced openings, each of said down lamp fixtures being disposed between and supported by said first and second elongated bracket members, each of said first and second bracket members having a cross-sectional configuration which includes first and second horizontally oriented leg portions interconnected by an intermediate leg portion, with the first leg portion being fixed to the second surface of the sheet metal member, and with the down lamp fixtures being fixed to the second leg portions.

* * * * *